US011336030B2

(12) United States Patent
Murata et al.

(10) Patent No.: US 11,336,030 B2
(45) Date of Patent: May 17, 2022

(54) ANTENNA MODULE AND COMMUNICATION DEVICE EQUIPPED WITH SAME

(71) Applicant: Murata Manufacturing Co., Ltd., Kyoto (JP)

(72) Inventors: Takaki Murata, Kyoto (JP); Kengo Onaka, Kyoto (JP); Hirotsugu Mori, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 79 days.

(21) Appl. No.: 16/997,263

(22) Filed: Aug. 19, 2020

(65) Prior Publication Data

US 2020/0381843 A1 Dec. 3, 2020

Related U.S. Application Data

(63) Continuation of application No. PCT/JP2019/002652, filed on Jan. 28, 2019.

(30) Foreign Application Priority Data

Feb. 22, 2018 (JP) ..... JP2018-029846

(51) Int. Cl.
*H01Q 1/24* (2006.01)
*H01Q 21/06* (2006.01)
(Continued)

(52) U.S. Cl.
CPC ..... *H01Q 21/065* (2013.01); *H01Q 9/045* (2013.01); *H01Q 9/0414* (2013.01); *H01Q 11/14* (2013.01)

(58) Field of Classification Search
CPC .... H01Q 21/065; H01Q 9/0414; H01Q 9/045; H01Q 11/14; H01Q 1/243
See application file for complete search history.

(56) References Cited

U.S. PATENT DOCUMENTS 6,326,920 B1 12/2001 Barnett et al.
6,642,892 B2 11/2003 Masaki et al.
(Continued)

FOREIGN PATENT DOCUMENTS

JP H06-029212 U 4/1994
JP 2001-284960 A 10/2001
(Continued)

OTHER PUBLICATIONS

International Search Report for International Application No. PCT/JP2019/002652 dated Mar. 5, 2019.
(Continued)

*Primary Examiner* — Dieu Hien T Duong
(74) *Attorney, Agent, or Firm* — Pearne & Gordon LLP

(57) ABSTRACT

An antenna module (100) includes an antenna element (121), a dielectric substrate (150) on which the antenna element (121) is arranged, and a flexible substrate (160) having a first surface and a second surface. The flexible substrate (160) has a first portion (165), a bent portion (166) bent from the first portion (165) such that the first surface is located in an outer side portion, and a flat second portion (167) extending further from the bent portion (166). The dielectric substrate (150) is arranged on the first surface of the second portion (167). The dielectric substrate (150) has a projection portion (152) projecting from a contact surface between the dielectric substrate (150) and the flexible substrate (160) toward a side of the first portion (165) along the second portion (167). At least part of the antenna element (121) is arranged on the projection portion (152).

20 Claims, 6 Drawing Sheets

(51) Int. Cl.
*H01Q 9/04* (2006.01)
*H01Q 11/14* (2006.01)

(56) References Cited

U.S. PATENT DOCUMENTS

| | | | | |
|---|---|---|---|---|
| 7,265,719 | B1 * | 9/2007 | Moosbrugger .... | H01Q 21/0025 343/700 MS |
| 2017/0279177 | A1 | 9/2017 | Oguri et al. | |
| 2018/0062263 | A1 * | 3/2018 | Ueda ..... | H01Q 21/29 |
| 2018/0151941 | A1 | 5/2018 | Orihara | |

FOREIGN PATENT DOCUMENTS

| | | | |
|---|---|---|---|
| JP | 2002-151928 | A | 5/2002 |
| JP | 2003-087022 | A | 3/2003 |
| JP | 2010-177983 | A | 8/2010 |
| JP | 2012-099987 | A | 5/2012 |
| JP | 2013-239902 | A | 11/2013 |
| JP | 2014-110617 | A | 6/2014 |
| JP | 2015-115706 | A | 6/2015 |
| JP | 2016-015636 | A | 1/2016 |
| JP | 2016-225796 | A | 12/2016 |
| JP | 6168258 | B1 | 7/2017 |

OTHER PUBLICATIONS

Written Opinion for International Application No. PCT/JP2019/002652 dated Mar. 5, 2019.

* cited by examiner

ANTENNA MODULE AND COMMUNICATION DEVICE EQUIPPED WITH SAME

This is a continuation of International Application No. PCT/JP2019/002652 filed on Jan. 28, 2019 which claims priority from Japanese Patent Application No. 2018-029846 filed on Feb. 22, 2018. The contents of these applications are incorporated herein by reference in their entireties.

BACKGROUND OF THE DISCLOSURE

Field of the Disclosure

The present disclosure relates to an antenna module and a communication device equipped with the same, and more particularly relates to a technology for miniaturizing an antenna module.

Description of the Related Art

As an antenna element (radiation element) of a mobile terminal (communication device) such as a smartphone or the like, a flat plate-shaped patch antenna is used in some cases. Since radio waves radiated by this patch antenna have high directivity (straightness), it is necessary to arrange antennas along respective surfaces of a housing of the mobile terminal in order to radiate radio waves in many directions.

Japanese Patent No. 6168258 (Patent Document 1) discloses a configuration, in an antenna module including a multilayer substrate having a rigid portion on which a radiation element is arranged and a flexible portion having flexibility in which a transmission line is formed, in which the rigid portion is bent with respect to an extending direction of the transmission line. Employing the antenna module in which the radiation element is arranged on the multilayer substrate having flexibility as described above makes it possible to easily incorporate the antenna module into a limited space in the housing.

Patent Document 1: Japanese Patent No. 6168258

BRIEF SUMMARY OF THE DISCLOSURE

In a mobile terminal, there are high needs for further reducing size and thickness, and it is therefore necessary to further reduce an antenna module used for the mobile terminal in size. Furthermore, increase in size of a liquid crystal display screen of the mobile terminal has also been advanced, and a region where the radiation element can be arranged in the mobile terminal tends to be further limited in accordance therewith.

The present disclosure has been made in order to solve the above-described problems, and an object thereof is to provide a miniaturized antenna module capable of being arranged in a limited space in a communication device.

An antenna module according to an aspect of the present disclosure includes: a first radiation element; a first substrate on which the first radiation element is arranged; and a second substrate. The second substrate has a first surface and a second surface on an opposite side from the first surface. The second substrate has a first portion that is flat, a bent portion that is bent from the first portion such that the first surface is located in an outer side portion, and a second portion that extends further from the bent portion and is flat. The first substrate is arranged on the first surface of the second portion of the second substrate. The first substrate has a projection portion that projects from a contact surface between the first substrate and the second substrate toward a side of the first portion along the second portion. At least part of the first radiation element is arranged on the projection portion.

Preferably, the antenna module further includes: a second radiation element arranged on a side of the first surface of the first portion of the second substrate.

Preferably, the antenna module further includes: a third substrate arranged on the first surface of the first portion of the second substrate. The second radiation element is arranged on the third substrate.

Preferably, a projection amount of the projection portion is an amount within a range from the contact surface to a height of the second radiation element.

Preferably, the antenna module further includes: a power feed circuit that is arranged at the first portion of the second substrate; and a power feed line that is formed in the second substrate and is configured to transmit a radio frequency signal from the power feed circuit to the first radiation element.

Preferably, the power feed circuit is arranged on the second surface of the first portion of the second substrate.

Preferably, the antenna module further includes: a third radiation element arranged on the first substrate.

A communication device according to another aspect of the present disclosure includes: the antenna module according to any one of those described above; and a housing at least part of which is formed of a resin. The radiation element of the antenna module is arranged so as to face a portion of the resin of the housing.

According to an antenna module according to the present disclosure, a first substrate arranged along a second portion of a second substrate projects from a contact surface between the first substrate and the second substrate, and at least part of a radiation element is arranged on the projection portion. As a result, the radiation element can be arranged in a dead space portion generated in a communication device by bending the second substrate, and it is thus possible to reduce the antenna module in size.

DETAILED DESCRIPTION OF THE DISCLOSURE

Figure 1:
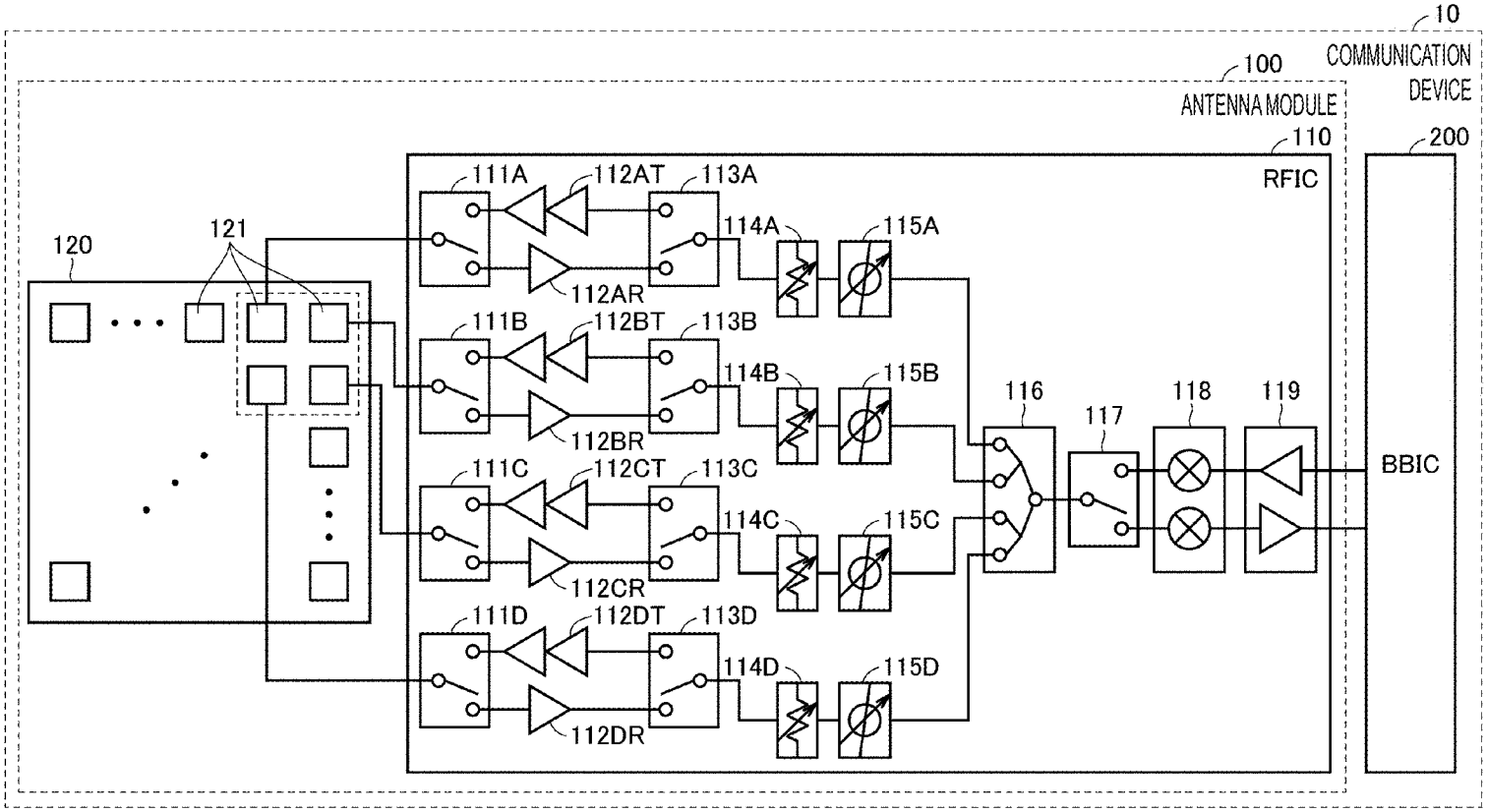
FIG. 1 is a block diagram of a communication device to which an antenna module according to an embodiment is applied.

Hereinafter, an embodiment of the present disclosure will be described in detail with reference to the drawings. Note that identical or corresponding elements in the drawings will be given the same reference numerals and description thereof will not be repeated.

(Basic Configuration of Communication Device)

FIG. 1 is a block diagram of an example of a communication device 10 to which an antenna module 100 according to the present embodiment is applied. The communication device 10 is, for example, a mobile terminal such as a mobile phone, a smartphone, a tablet, or the like, a personal computer having a communication function, or the like.

Referring to FIG. 1, the communication device 10 includes the antenna module 100 and a BBIC 200 that constitutes a baseband signal processing circuit. The antenna module 100 includes an RFIC (Radio Frequency Integrated Circuit) 110, which is an example of a power feed circuit, and an antenna array 120. The communication device 10 up-converts a signal transmitted from the BBIC 200 to the antenna module 100 into a radio frequency signal and radiates the resulting signal from the antenna array 120, and down-converts the radio frequency signal received by the antenna array 120 and performs signal processing on the resulting signal by the BBIC 200.

Note that in FIG. 1, for ease of explanation, only the configurations corresponding to four antenna elements (radiation elements) 121 among the plurality of antenna elements 121 constituting the antenna array 120 are illustrated, and the configurations corresponding to the other antenna elements 121 having the same configuration are omitted.

The RFIC 110 includes switches 111A to 111D, 113A to 113D, and 117, power amplifiers 112AT to 112DT, low noise amplifiers 112AR to 112DR, attenuators 114A to 114D, phase shifters 115A to 115D, a signal multiplexer/demultiplexer 116, a mixer 118, and an amplifier circuit 119.

When transmitting a radio frequency signal, the switches 111A to 111D and 113A to 113D are switched to the power amplifiers 112AT to 112DT sides, and the switch 117 is connected to a transmission-side amplifier of the amplifier circuit 119. When receiving a radio frequency signal, the switches 111A to 111D and 113A to 113D are switched to the low noise amplifiers 112AR to 112DR sides, and the switch 117 is connected to a reception-side amplifier of the amplifier circuit 119.

The signal transmitted from the BBIC 200 is amplified by the amplifier circuit 119, and is up-converted by the mixer 118. The transmission signal, which is the up-converted radio frequency signal, is demultiplexed into four signals by the signal multiplexer/demultiplexer 116, and is fed to the different antenna elements 121 through four signal paths, respectively. At this time, by individually adjusting the phase shift degrees of the phase shifters 115A to 115D arranged on the respective signal paths, the directivity of the antenna array 120 can be adjusted.

Furthermore, the reception signals, which are radio frequency signals received by the respective antenna elements 121, pass through four different signal paths, respectively, and are multiplexed by the signal multiplexer/demultiplexer 116. The multiplexed reception signal is down-converted by the mixer 118, amplified by the amplifier circuit 119, and transmitted to the BBIC 200.

The RFIC 110 is formed as, for example, a one-chip integrated circuit component including the above-described circuit configuration. Alternatively, the units (switches, power amplifier, low noise amplifier, attenuator, and phase shifter) corresponding to each of the antenna elements 121 in the RFIC 110 may be formed as a one-chip integrated circuit component for each of the corresponding antenna elements 121.

(Description of Comparative Example)

Figure 2:
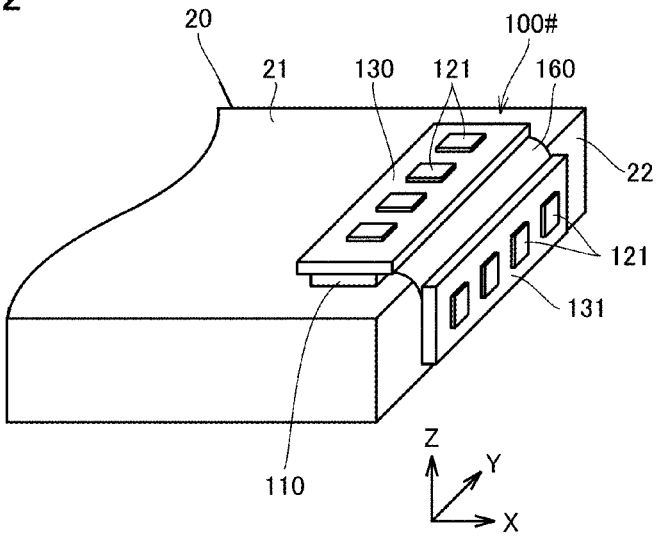
FIG. 2 is a diagram for illustrating an arrangement of an antenna module according to a comparative example.

Arrangement of an antenna module 100 # in a comparative example will be described with reference to FIG. 2 and FIGS. 3A, 3B and 3C. FIG. 2 is a perspective view in which the antenna module 100 # is arranged on a mounting substrate 20, and FIGS. 3A, 3B and 3C include diagrams illustrating a schematic manufacturing process and an example of attachment to a communication device, of the antenna module 100 #.

Referring to FIG. 2 and FIGS. 3A, 3B and 3C, the antenna module 100 # is arranged on one main surface 21 of the mounting substrate 20 with the RFIC 110 interposed therebetween. On the RFIC 110, dielectric substrates 130 and 131 are arranged with a flexible substrate 160 having flexibility interposed therebetween. The antenna elements 121 are arranged on each of the dielectric substrates 130 and 131.

The dielectric substrate 130 extends along the main surface 21, and the antenna elements 121 are arranged thereon such that radio waves are radiated in the normal direction (that is, the Z-axis direction in FIG. 2) of the main surface 21.

The flexible substrate 160 is bent so as to face a side surface 22 from the main surface 21 of the mounting substrate 20, and the dielectric substrate 131 is arranged on a surface along the side surface 22. The antenna elements 121 are arranged on the dielectric substrate 131 such that radio waves are radiated in the normal direction (that is, the X-axis direction in FIG. 2) of the side surface 22. Note that instead of the flexible substrate 160, a rigid substrate having a thermoplasticity, for example, may be provided.

The dielectric substrates 130, 131 and a dielectric substrate 162 (FIGS. 3A, 3B and 3C) of the flexible substrate 160 are formed of, for example, a resin such as epoxy, polyimide, or the like. In addition, the dielectric substrate 162 of the flexible substrate 160 may be formed using a Liquid Crystal Polymer (LCP) or a fluorine-based resin having a lower dielectric constant. Note that the dielectric substrates 130 and 131 may also be formed using the LCP or the fluorine-based resin in the same manner as the dielectric substrate 162.

Figure 3A:
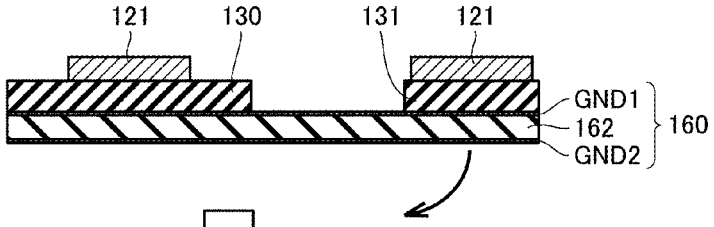
FIGS. 3A, 3B and 3C include diagrams illustrating a manufacturing process and an example of attachment to a communication device of the antenna module according to the comparative example.
Figure 3B:
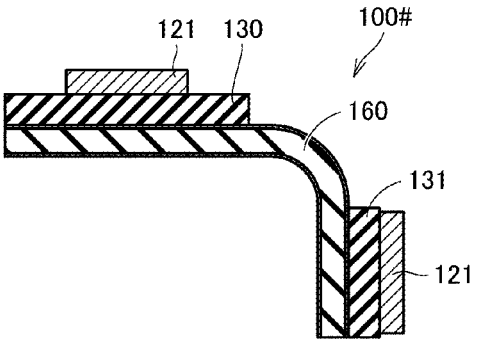
Figure 3C:
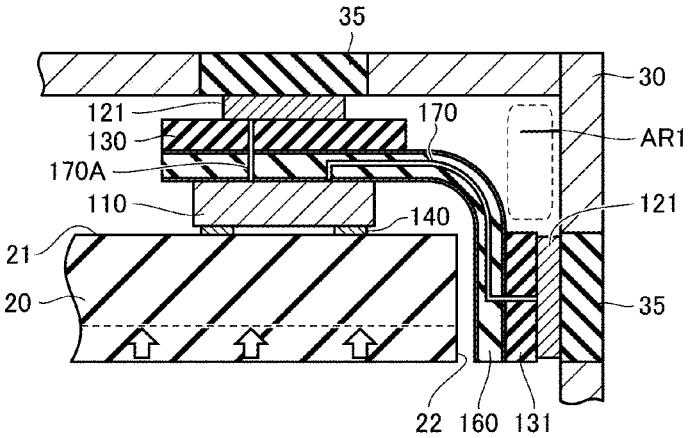

Next, referring to FIGS. 3A, 3B and 3C, a manufacturing process of the antenna module 100 # illustrated in FIG. 2 will be schematically described.

As illustrated in a cross-sectional view of FIG. 3A, first, the flexible substrate 160 is formed by laminating ground electrodes GND1 and GND2 on front and rear surfaces of the dielectric substrate 162 having flexibility. Thereafter, the dielectric substrate 130 is laminated on one end side and the dielectric substrate 131 is laminated on the other end side on the ground electrode GND1 of the flexible substrate 160. Then, the antenna elements 121 are arranged on the dielectric substrates 130 and 131.

Next, in a portion of the flexible substrate 160 where the dielectric substrates 130 and 131 are not formed, the flexible substrate 160 is bent and is made to have a shape as illustrated in FIG. 3B. In FIG. 3B, the flexible substrate 160 is bent by about 90° such that the surface (first surface) where the ground electrode GND1 is formed is located in an outer side portion and the surface (second surface) where the ground electrode GND2 is formed is located in an inner side portion. Note that the bending angle is not limited to 90°, and may be an angle such as 70° or 80°, for example.

The RFIC 110 is arranged on the main surface 21 of the mounting substrate 20 with solder bumps 140 interposed therebetween, and the antenna module 100 # is arranged such that the dielectric substrate 130 is positioned on the RFIC 110 (FIG. 3C). At this time, the dielectric substrate 131 arranged on the other end side of the flexible substrate 160 is arranged so as to face the side surface 22 of the mounting substrate 20.

Radio frequency signals are transmitted to the antenna elements 121 from the RFIC 110 through power feed lines 170 and 170A.

The antenna module 100 # mounted on the mounting substrate 20 is attached to a corner portion of a substantially box-shaped housing 30 of the communication device 10. Note that the corner portion of the housing 30 may have some roundness in terms of design. With this configuration, the antenna elements 121 are arranged so as to face different surfaces of the housing 30 of the communication device 10. Note that when the housing 30 is made of metal, since the housing 30 functions as a shield for the radio waves radiated from the antenna elements 121, resin portions 35 are partially formed in the portions facing the antenna element 121.

Configuring the antenna module 100 # as described above makes it possible to radiate the radio waves in two directions.

(Description of Antenna Module According to Embodiment)

In the comparative example as described above, a region in which the antenna element 121 can be arranged at a portion along the side surface 22 of the mounting substrate 20 is limited to a region corresponding to the thickness of the mounting substrate 20. Therefore, if the thickness of the mounting substrate 20 is further reduced as indicated by the arrows in FIG. 3C in order to reduce the thickness of the communication device 10, there is a risk that the planar region of the dielectric substrate 131 will be narrowed, and the antenna element 121 will not be able to be arranged.

Accordingly, in the present embodiment, by effectively utilizing a dead space AR1 (a region indicated by the broken line in FIG. 3C) generated in an inner side portion of the housing 30, a method of securing a region in which the antenna element 121 can be arranged in the thickness direction of the mounting substrate 20 is employed.

Figure 4:
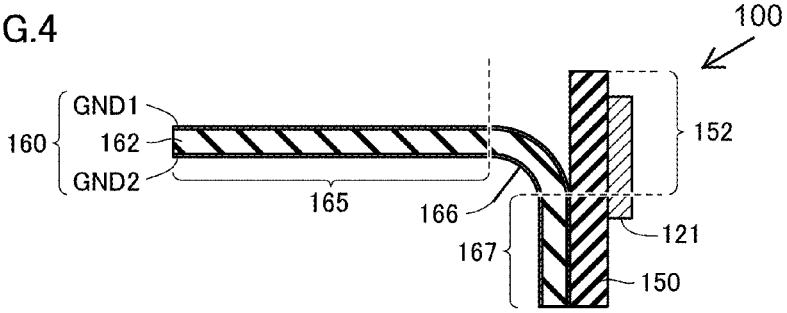
FIG. 4 is a diagram illustrating a first example of the antenna module according to the embodiment.

FIG. 4 is a diagram illustrating a first example of the antenna module 100 according to the embodiment. Referring to FIG. 4, the antenna module 100 includes the flexible substrate 160 obtained by laminating the ground electrodes GND1 and GND2 on the dielectric substrate 162, a dielectric substrate 150, and the antenna element 121.

In the same manner as in the case of the comparative example, the flexible substrate 160 is bent such that the first surface where the ground electrode GND1 is formed is located in the outer side portion. Here, a flat portion on one end side of the flexible substrate 160 is referred to as a "first portion 165", a portion bent from the first portion 165 is referred to as a "bent portion 166", and a flat portion further extending from the bent portion 166 is referred to as a "second portion 167".

The dielectric substrate 150 is arranged along the first surface of the second portion 167, and one end thereof projects toward the side of the first portion 165 from a contact surface between the dielectric substrate 150 and the flexible substrate 160. The antenna element 121 is arranged such that at least part thereof overlaps with the projection portion (projection portion 152) of the dielectric substrate 150.

Figure 5:
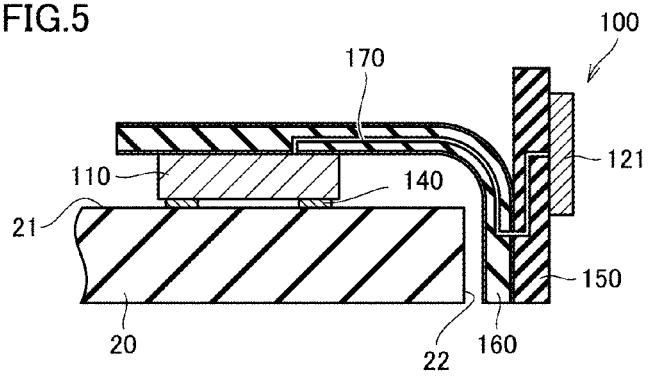
FIG. 5 is a diagram illustrating an example of mounting of the antenna module in FIG. 4 on a mounting substrate.

In the same manner as the dielectric substrates 130 and 131 in FIGS. 3A, 3B and 3C, the dielectric substrate 150 and a dielectric substrate 150A, which will be described later with reference to FIG. 7 to FIG. 10, are also formed using a resin such as epoxy, polyimide, or the like, or a liquid crystal polymer (LCP) or a fluorine-based resin having a lower dielectric constant. Note that the material of the dielectric substrates 150 and 150A may be the same material as that of the dielectric substrate 162 of the flexible substrate 160, or may be a different material. FIG. 5 is a diagram illustrating an example of a case in which the antenna module 100 in FIG. 4 is mounted on the mounting substrate 20. Referring to FIG. 5, the RFIC 110 is mounted on the main surface 21 of the mounting substrate 20 with the solder bumps 140 interposed therebetween, in the same manner as in the comparative example in FIGS. 3A, 3B and 3C. Then, the second surface of the first portion 165 of the antenna module 100 is connected to the surface of the RFIC 110 on the opposite side from the side facing the mounting substrate 20. At this time, the antenna module 100 is arranged such that the second portion 167 faces the side surface 22 of the mounting substrate 20. A radio frequency signal is transmitted to the antenna element 121 from the RFIC 110 through the power feed line 170 passing through the insides of the flexible substrate 160 and the dielectric substrate 150.

By employing the configuration as described above, since the antenna element 121 can be arranged in the portion of the dead space AR1 in FIGS. 3A, 3B and 3C, it is possible to reduce the thickness of each of the mounting substrate 20 and the communication device 10 without impairing the function of the antenna that radiates the radio wave in the side surface direction of the mounting substrate 20.

Hereinafter, examples of other variations of the antenna module according to the embodiment will be described with reference to FIG. 6 to FIG. 10.

Figure 6:
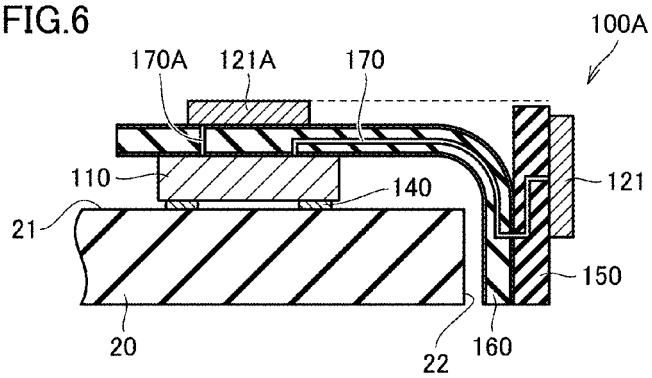
FIG. 6 is a diagram illustrating a second example of the antenna module according to the embodiment.

FIG. 6 is a diagram illustrating a second example of the antenna module according to the embodiment, and in an antenna module 100A in the diagram, an antenna element 121A is arranged also on the first portion 165 side of the flexible substrate 160. The antenna element 121A and the RFIC 110 are connected to each other with a power feed line 170A, and a radio frequency signal is transmitted from the RFIC 110 to the antenna element 121A through the power feed line 170A.

Employing the configuration as described above makes it possible to output the radio waves in the normal directions of both the main surface 21 and the side surface 22 of the mounting substrate 20.

Note that the antenna element 121A is arranged, in some cases, so as to make contact with the housing in the same manner as in the comparative example in FIGS. 3A, 3B and 3C, and it is therefore desirable to make an projection amount of the projection portion 152 of the dielectric substrate 150 to be an amount within a range up to the height of the antenna element 121A.

Figure 7:
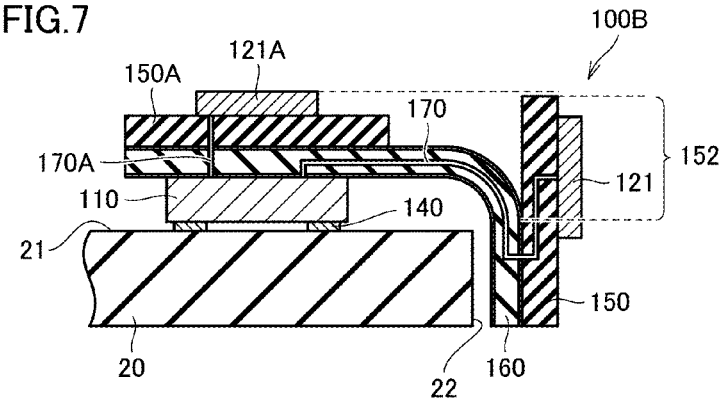
FIG. 7 is a diagram illustrating a third example of the antenna module according to the embodiment.

FIG. 7 is a diagram illustrating a third example of the antenna module according to the embodiment, and in an antenna module 100B, the antenna element 121A arranged on the first portion 165 side is not directly arranged on the flexible substrate 160 as illustrated in FIG. 6, but is arranged thereon with the dielectric substrate 150A interposed therebetween. Since a frequency band width of the antenna is determined by a distance between the antenna element and the ground electrode, when it is desired to make a frequency band width of the antenna element 121A wider than in the case of FIG. 6, for example, the dielectric substrate 150A as illustrated in the example in FIG. 7 may be used.

Note that in the case of FIG. 7 as well, it is desirable to make the projection amount of the projection portion 152 of the dielectric substrate 150 on the second portion 167 side to be within a range up to the height of an antenna element 121A.

Figure 8:
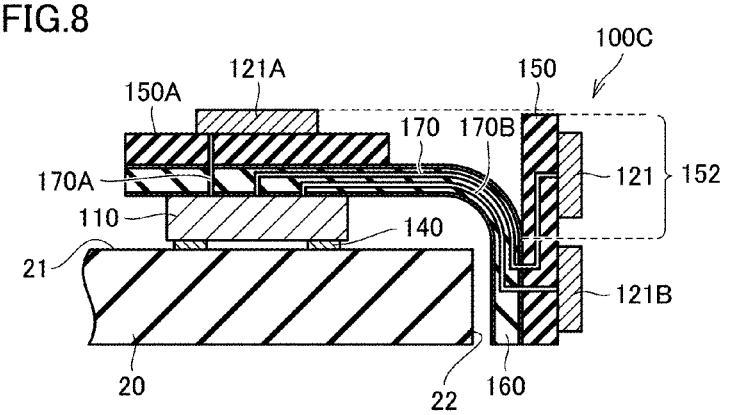
FIG. 8 is a diagram illustrating a fourth example of the antenna module according to the embodiment.

FIG. 8 is a diagram illustrating a fourth example of the antenna module according to the embodiment, an antenna module 100C has a configuration in which the antenna element 121B is arranged on the dielectric substrate 150 in addition to the antenna element 121. The antenna element 121 and the antenna element 121B are arranged apart from each other in the thickness direction of the mounting substrate 20 on the dielectric substrate 150. A radio frequency signal is transmitted to the antenna element 121B from the RFIC 110 with a power feed line 170B. As described above, providing the projection portion 152 at the dielectric substrate 150 also makes it possible to arrange a plurality of antenna elements in the thickness direction of the mounting substrate 20.

Figure 9:
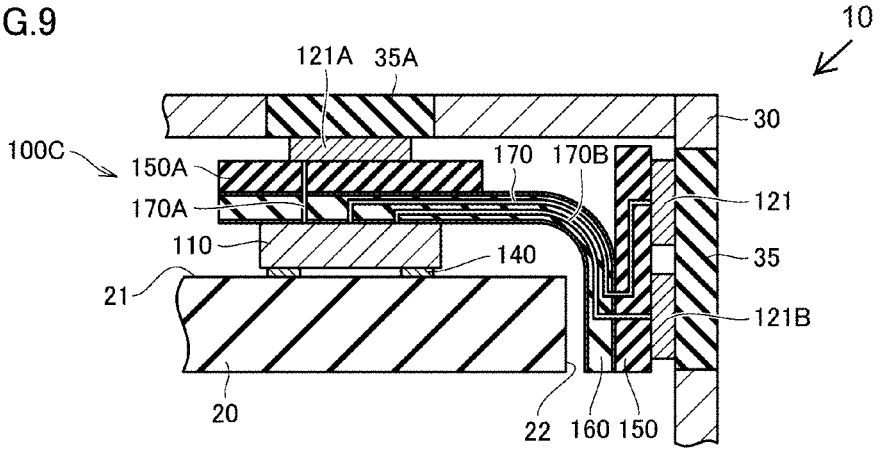
FIG. 9 is a diagram illustrating an example of attachment of the antenna module in FIG. 8 to a communication device.

FIG. 9 is a diagram illustrating a state in which the antenna module 100C illustrated in FIG. 8 is attached to the communication device 10. As illustrated in FIG. 9, the antenna element 121A is arranged so as to face a resin portion 35A provided in a portion facing the main surface 21 of the mounting substrate 20, in the housing 30. Furthermore, the antenna elements 121 and 121B are arranged so as to face the resin portion 35 provided in a portion facing the side surface 22 of the mounting substrate 20, in the housing 30. Note that there may be a gap between each of the antenna elements 121, 121A, and 121B and each of the resin portions 35 and 35A.

When comparing FIGS. 3A, 3B and 3C in the comparative example and FIG. 9, in FIG. 9, the antenna element 121 is arranged also in the portion of the dead space AR1 in FIGS. 3A, 3B and 3C. This makes it possible, even if the mounting substrate 20 is reduced in thickness, to secure the arrangement region of the antenna element on the side surface side. Accordingly, it is possible to efficiently arrange the antenna elements in a limited space in the communication device, and it is possible to contribute to reduction in size and thickness of the communication device.

(Modifications)

In any of the examples of the above-described embodiments, the configuration has been described in which the projection portion is provided at the dielectric substrate facing the side surface of the mounting substrate, but conversely, a configuration may be such that the dead space is utilized by providing the projection portion at the dielectric substrate facing the main surface of the mounting substrate.

Figure 10:
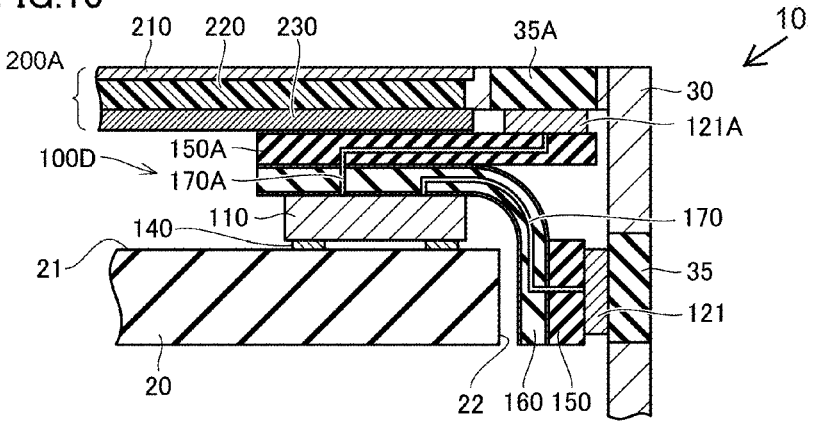
FIG. 10 is a diagram illustrating an antenna module according to a modification of the embodiment.

For example, in recent years, due to an increase in screen size of a smartphone, a liquid crystal panel is arranged, in some cases, up to a portion close to an end portion of the housing. As illustrated in FIG. 10, a liquid crystal panel 200A is configured by including a liquid crystal 220 that functions as a display screen, a touch panel 210 that is arranged on the surface of the liquid crystal 220 and receives an operation from a user, and a chassis 230 that supports and protects these components. Then, the liquid crystal panel 200A is arranged so as to overlap with the mounting surface of the mounting substrate 20 when viewed in a plan view.

When the antenna element is arranged on the back surface of the liquid crystal panel 200A, since a conductive member formed in each component of the liquid crystal panel 200A may function as a shield, the radio wave cannot be radiated to the outside.

Therefore, in the case as described above, the dielectric substrate 150A on the first portion 165 side is made to project in the side surface direction of the housing 30, and the antenna element 121A is arranged on the projection portion, whereby the antenna element 121A can be arranged so as not to overlap with the liquid crystal panel 200A when viewed in a plan view. Accordingly, even in the case where the liquid crystal panel is arranged up to a portion close to the end portion of the housing, it is possible to radiate the radio wave in the normal direction of the liquid crystal panel 200A from the end portion of the housing 30.

Note that in the above-described embodiment, the configuration in which the radiation electrode is arranged on the surface of the dielectric layer has been described as an example, but the configuration may be such that the radiation electrode is arranged inside the dielectric layer. That is, the radiation electrode may not be exposed from the dielectric layer, and may be covered by resist or a coverlay which is a thin film dielectric layer. Additionally, in the same manner, the ground electrode may be configured so as to be formed inside the dielectric layer.

Furthermore, in the above-described embodiment, the example has been described in which the flexible substrate forms a strip line in which the ground electrodes are arranged on both surfaces of the dielectric layer. However, the flexible substrate may be formed as a microstrip line in which the ground electrode is arranged only on one side of the dielectric layer, or as a coplanar line in which the ground electrode and the power feed line are arranged in the same layer in the dielectric layer.

The embodiment described above has the configuration in which the flexible substrate is attached to the rear surface side (mounting substrate side) of the dielectric substrate arranged on the side surface side of the mounting substrate, but it is also possible to employ another configuration as the attachment mode of the flexible substrate to the dielectric substrate. Specifically, the flexible substrate may be attached on the front surface side (housing side) of the dielectric substrate.

Figure 11:
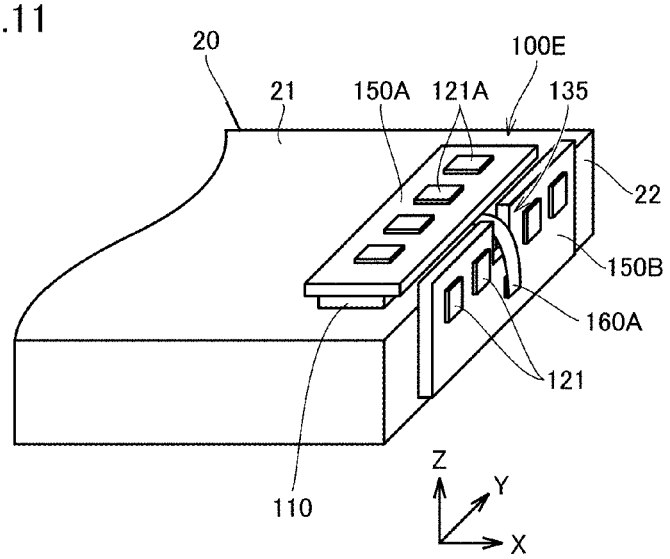
FIG. 11 is a first diagram illustrating a modification of an attachment mode of a flexible substrate to a dielectric substrate.
Figure 12:
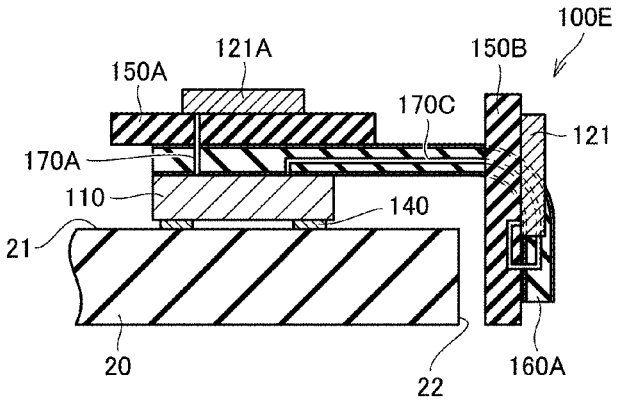
FIG. 12 is a second diagram illustrating the modification of the attachment mode of the flexible substrate to the dielectric substrate.

FIG. 11 and FIG. 12 are diagrams illustrating a modification of the flexible substrate to the dielectric substrate arranged on the side surface side of the mounting substrate. FIG. 11 is a perspective view when an antenna module 100E to which the modification is applied is mounted on the mounting substrate 20. FIG. 12 is a cross-sectional view of the antenna module 100E illustrated in FIG. 11.

Referring to FIG. 11 and FIG. 12, in the antenna module 100E, in the vicinity of the center of the side in the Y-axis direction of a dielectric substrate 150B arranged on the side surface 22 side of the mounting substrate 20, a cutout portion 135 is partially formed. A flexible substrate 160A passes through the cutout portion 135, projects from the rear surface side of the dielectric substrate 150B toward the front surface side where the antenna elements 121 are arranged, and is connected to the front surface of the dielectric substrate 150B by using an adhesive member or a connector.

A radio frequency signal from the RFIC 110 is transmitted to the antenna element 121 arranged on the dielectric substrate 150B through a power feed line 170C passing through the flexible substrate 160A and the dielectric substrate 150B.

Note that in the above-described embodiment, the dielectric substrates 150 and 150B each correspond to the "first substrate" of the present disclosure, the flexible substrates 160 and 160A each correspond to the "second substrate" of the present disclosure, and the dielectric substrate 150A corresponds to the "third substrate" of the present disclosure. Furthermore, the antenna elements 121, 121A, and 121B correspond to the "first radiation element", the "second radiation element", and the "third radiation element" of the present disclosure, respectively.

It should be considered that the embodiments disclosed herein are illustrative in all respects and are not restrictive. The scope of the present disclosure is defined not by the above description of the embodiment but by the scope of the claims and is intended to encompass all changes within the meaning and scope equivalent to the scope of the claims.

10 COMMUNICATION DEVICE
20 MOUNTING SUBSTRATE
21 MAIN SURFACE
22 SIDE SURFACE
30 HOUSING
35, 35A, 35B RESIN PORTION
100, 100A TO 100C, 100 # ANTENNA MODULE
111A TO 111D, 113A TO 113D, 117 SWITCH
112AR TO 112DR LOW NOISE AMPLIFIER
112AT TO 112DT POWER AMPLIFIER
114A TO 114D ATTENUATOR
115A TO 115D PHASE SHIFTER
116 SIGNAL MULTIPLEXER/DEMULTIPLEXER
118 MIXER
119 AMPLIFIER CIRCUIT
120 ANTENNA ARRAY
121, 121A, 121B ANTENNA ELEMENT
130, 131, 150, 150A, 150B, 162 DIELECTRIC SUBSTRATE
140 SOLDER BUMP
152 PROJECTION PORTION
160, 160A FLEXIBLE SUBSTRATE
165 FIRST PORTION
166 BENT PORTION
167 SECOND PORTION
170, 170A TO 170C POWER FEED LINE
200A LIQUID CRYSTAL PANEL
AR1 DEAD SPACE
GND1, GND2 GROUND ELECTRODE

The invention claimed is:

1. An antenna module comprising:
a first radiation element;
a first substrate on which the first radiation element is arranged; and
a second substrate having a first surface and a second surface on an opposite side from the first surface,
wherein the second substrate has
a first portion being flat,
a bent portion being bent from the first portion such that the first surface is located in an outer side portion, and
a second portion extending further from the bent portion and being flat,
the first substrate is arranged on the first surface of the second portion,
the first substrate has a projection portion projecting from a contact surface between the first substrate and the second substrate toward a side of the first portion along the second portion, and
at least a part of the first radiation element is arranged on the projection portion.

2. The antenna module according to claim 1, further comprising:
a second radiation element arranged on a side of the first surface of the first portion of the second substrate.

3. The antenna module according to claim 2, further comprising:
a third substrate arranged on the first surface of the first portion of the second substrate,
wherein the second radiation element is arranged on the third substrate.

4. The antenna module according to claim 3,
wherein a projection amount of the projection portion is an amount within a range from the contact surface to a height of the second radiation element.

5. The antenna module according to claim 4, further comprising:
a power feed circuit arranged at the first portion of the second substrate; and
a power feed line provided in the second substrate and configured to transmit a radio frequency signal from the power feed circuit to the first radiation element.

6. The antenna module according to claim 4, further comprising:
a third radiation element arranged on the first substrate.

7. A communication device equipped with the antenna module according to claim 4, the communication device comprising:
a housing at least partially comprising a resin,
wherein the radiation element of the antenna module is arranged so as to face a portion of the resin of the housing.

8. The antenna module according to claim 3, further comprising:
a power feed circuit arranged at the first portion of the second substrate; and
a power feed line provided in the second substrate and configured to transmit a radio frequency signal from the power feed circuit to the first radiation element.

9. The antenna module according to claim 3, further comprising:
a third radiation element arranged on the first substrate.

10. A communication device equipped with the antenna module according to claim 3, the communication device comprising:
a housing at least partially comprising a resin,
wherein the radiation element of the antenna module is arranged so as to face a portion of the resin of the housing.

11. The antenna module according to claim 2, further comprising:
a power feed circuit arranged at the first portion of the second substrate; and
a power feed line provided in the second substrate and configured to transmit a radio frequency signal from the power feed circuit to the first radiation element.

12. The antenna module according to claim 2, further comprising:
a third radiation element arranged on the first substrate.

13. A communication device equipped with the antenna module according to claim 2, the communication device comprising:

a housing at least partially comprising a resin, wherein the radiation element of the antenna module is arranged so as to face a portion of the resin of the housing.

14. The antenna module according to claim 1, further comprising:

a power feed circuit arranged at the first portion of the second substrate; and a power feed line provided in the second substrate and configured to transmit a radio frequency signal from the power feed circuit to the first radiation element.

15. The antenna module according to claim 14, wherein the power feed circuit is arranged on the second surface of the first portion of the second substrate.

16. The antenna module according to claim 15, further comprising:

a third radiation element arranged on the first substrate.

17. The antenna module according to claim 14, further comprising:

a third radiation element arranged on the first substrate.

18. A communication device equipped with the antenna module according to claim 14, the communication device comprising:

a housing at least partially comprising a resin, wherein the radiation element of the antenna module is arranged so as to face a portion of the resin of the housing.

19. The antenna module according to claim 1, further comprising:

a third radiation element arranged on the first substrate.

20. A communication device equipped with the antenna module according to claim 1, the communication device comprising:

a housing at least partially comprising a resin, wherein the radiation element of the antenna module is arranged so as to face a portion of the resin of the housing.

* * * * *